United States Patent [19]

Stein et al.

[11] Patent Number: 4,866,802

[45] Date of Patent: Sep. 19, 1989

[54] ROUGHING MACHINE FOR FOOTWARE UPPER ASSEMBLIES AND A SYSTEM THAT INCLUDES THE ROUGHING MACHINE BUT TYPICALLY INCLUDES AS WELL OTHER MACHINES AHEAD OF AND FOLLOWING

[75] Inventors: Martin L. Stein, Bedford, Mass.; Gregory A. Williams, Litchfield, N.H.

[73] Assignee: International Shoe Machine Corporation, Nashua, N.H.

[21] Appl. No.: 179,172

[22] Filed: Apr. 8, 1988

[51] Int. Cl.[4] ..... A43D 11/00

[52] U.S. Cl. ..... 12/1 A; 12/1 R

[58] Field of Search ..... 12/1 A, 1 R, 70, 77, 12/78; 69/6.5

[56] References Cited

U.S. PATENT DOCUMENTS

| | | | |
|---|---|---|---|
| 3,518,851 | 1/1970 | Boot et al. | 12/127 |
| 3,559,428 | 2/1971 | Babson | 69/6.5 |
| 3,579,695 | 5/1971 | Boot et al. | 69/6.5 |
| 3,645,118 | 2/1972 | Babson | 69/6.5 |
| 3,704,604 | 12/1972 | Boot et al. | 69/6.5 |
| 3,843,985 | 10/1974 | Leonhardt | 12/1 R |
| 3,932,907 | 1/1976 | Vornberger | 12/1 R |
| 3,975,932 | 8/1976 | Vornberger | 69/6.5 |
| 3,992,743 | 11/1976 | Vornberger | 12/1 R |
| 4,020,660 | 5/1977 | Bergeron | 69/6.5 |
| 4,090,378 | 5/1978 | Sommer | 69/6.5 |
| 4,126,020 | 11/1978 | Tutt et al. | 69/6.5 |
| 4,126,021 | 11/1978 | Davies et al. | 69/6.5 |
| 4,134,278 | 1/1979 | Becka | 69/6.5 |
| 4,167,103 | 9/1979 | Becka | 69/6.5 |
| 4,181,994 | 1/1980 | Gruber | 12/1 A |
| 4,331,011 | 5/1982 | Elliott et al. | 69/6.5 |
| 4,387,581 | 6/1983 | Reedman et al. | 69/6.5 |
| 4,389,861 | 6/1983 | Peck et al. | 69/6.5 |
| 4,391,011 | 7/1983 | Peck et al. | 69/6.5 |
| 4,416,031 | 11/1983 | Shutt et al. | 12/127 |
| 4,452,057 | 7/1984 | Davies et al. | 69/6.5 |
| 4,555,823 | 12/1985 | Pedretti et al. | 12/77 |
| 4,561,139 | 12/1985 | Becka et al. | 12/1 R |
| 4,649,585 | 3/1987 | Petrzelka et al. | 12/17.2 |
| 4,756,038 | 7/1988 | Stein | 12/1 R |
| 4,769,866 | 9/1988 | Williams | 12/1 A |

FOREIGN PATENT DOCUMENTS

| | | |
|---|---|---|
| 1037211 | 8/1978 | Canada . |
| 1950363 | 8/1973 | Fed. Rep. of Germany . |
| 2077090 | 12/1981 | United Kingdom . |
| 2173988 | 10/1985 | United Kingdom . |

OTHER PUBLICATIONS

Circular 983—Automatic Bottom Roughing Machine—Model C International Shoe Machine Corporation.

EPO Publication Number 0250214, published Dec. 23, 1987.

EPO Publication No. 0091321 CB1.

*Primary Examiner*—Steven N. Meyers

*Attorney, Agent, or Firm*—Robert Shaw

[57] ABSTRACT

In an integrated system to achieve a number of operations on a footwear upper assembly, an automatic rougher that includes a roughing tool adapted to remove material—and hence rough—the cement margin (or bonding surface) of the footwear upper assembly to provide a cementing surface onto which an outer sole is later applied. The cement margin (or bonding surface), as is known in this art, typically follows a closed-loop path that rapidly changes in all directions of an X-Y-Z coordinate system and the roughing tool must be continuously re-oriented to the many direction changes of the cement margin in order to track the margin. According to the present teaching the upper assembly, and hence the cement margin thereof, is ordinarily moved in rotational movement, rocking movement, transverse translational movement, and, also, vertical translational movement (i.e., movement toward and away from the roughing tool) during the course of roughing. According to the present teaching, real-time data is assembled which may be used to achieve a later operation: e.g., the path of the cement margin is digitized and that digitized information is used to guide a cementer to apply adhesive unto the cement margin to adhere an outer sole to the upper assembly.

19 Claims, 15 Drawing Sheets

ROUGHING MACHINE FOR FOOTWARE UPPER ASSEMBLIES AND A SYSTEM THAT INCLUDES THE ROUGHING MACHINE BUT TYPICALLY INCLUDES AS WELL OTHER MACHINES AHEAD OF AND FOLLOWING

The present invention relates to a novel automatic roughing machine to rough the cement margin of a footwear upper assembly and to an integrated system that includes the same, but typically includes, as well, transfer machines and other machines to process the footwear upper assembly with information transfer to and from machines in the system, whereby data gathered by one machine is transferred to another machine.

Attention is called to the U.S. Pat. No. 4,561,139 (Becka et al), as well as the art therein cited.

Survival dictates that advanced nations, in the manufacturing context, mechanize more and more aspects of the manufacturing process. The techniques being employed for such purposes tend toward digital technology using microprocessor chips to perform untold—and in real-time—calculations representative of aspects of machine operation, for example. Time to perform an operation enters into all equations in this context. Thus, for example, it may be possible to mechanize and automate a particular manufacturing operation in shoe fabrication process to which the present invention is directed, but then significant improvement can be effected by replacing or eliminating steps in the operation.

More specifically, in the shoe fabrication process (in this explanation reference is made to shoes, but the invention applies to footwear more generally), a shoe upper assembly is lasted, then its cement margin is roughed, then a ribbon of adhesive is applied to the cement margin by a bottom cementing machine, then the upper assembly (including the adhesive) is heated to some predetermined temperature in a drying tunnel, then an outer sole is applied by known mechanisms. According to the present teaching digital (or analog) data representative of the path of the cement margin is generated in the roughing machine while the machine is roughing the cement margin. That digital (or analog) data is stored or transferred to the bottom cementing machine in a form which is used to control its servomotors and controls so that the combined mechanical machine will, on demand, reproduce the path of work (in the X-Y plane) previously generated by the roughing machine and that essentially duplicates the roughing machine roughing path—except that the roughing tool of the roughing machine is replaced by an adhesive dispenser of the cementing machine which applies a ribbon of adhesive onto the previously roughed cement margin. It is an ultimate truth that time is money to this industry. Hence, anything that reduces processing time is susceptible to close scrutiny.

More specifically according to a most important aspect of this invention it is an objective of the invention to provide in one operation digital data which represents the path of the cement margin for roughing, the digital data being generated while the cement margin is being roughed, the digital data typically being recalled in time to guide an adhesive dispenser in a later operation of a bottom cementing machine to guide that machine along the now roughed cement margin to apply an adhesive thereto.

Thus according to the present inventive concept a time consuming—and hence costly—step is eliminated: the tracing of the path for the bottom-cementing step.

A further objective is to provide a system in which a footwear upper assembly is presented to a roughing machine in a manner that permits or allows an essentially constant force between the upper (being roughed) and the roughing tool, despite rapid change in the contour of the surface being roughed (e.g., at the ball region of a women's shoe).

A still further objective is to provide a uniformly roughed cement margin despite imperfection that would tend to corrupt the uniformity.

Another objective is to provide a system which is almost wholly binary digital in its sensing and calculation functions to minimize—even to or almost to zero—noise, drift, sensitivity and the like.

These and still further objectives are discussed hereinafter and are embraced by the appended claims.

The foregoing objectives are achieved, generally, in a system to effect operations on a footwear upper assembly that includes, typically as a first machine, an automatic rougher, and, as a further machine—of a plurality of machines—bottom cementer. The footwear upper assembly includes a last, a footwear upper disposed on the last and an insole on the last bottom; the footwear upper assembly has a cement margin (i.e., bonding surface) to-be-roughed by the automatic rougher. The automatic rougher includes a roughing tool that is operable to remove material from the cement margin (i.e., the bonding surface) to provide a cementing surface. The rougher includes an attachment mechanism that functions to receive the footwear upper assembly and secure the same relative to the automatic rougher. The attachment mechanism is operable to apply motion of the footwear upper assembly relative to the roughing tool, which motion includes translational movement of the footwear upper assembly toward and away from the roughing tool in the course of roughing to present the footwear upper assembly acceptably to the roughing tool. Typically the rougher includes a sensing structure that is operable to sense position of the cement margin relative to the roughing tool as the roughing tool effects removal of the material during a cycle of roughing. A computer is typically connected to receive electrical feedback signals from the sensor mechanism as the roughing proceeds through the roughing cycle. The feedback signals include tracing data representative of the roughing path transversed by the roughing tool. That tracing data is employed by a subsequent machine in the system to control operation of the subsequent machine. The invention is also found in a novel rougher.

The invention is hereinafter described with reference to the accompanying drawing in which.

Figure 1:
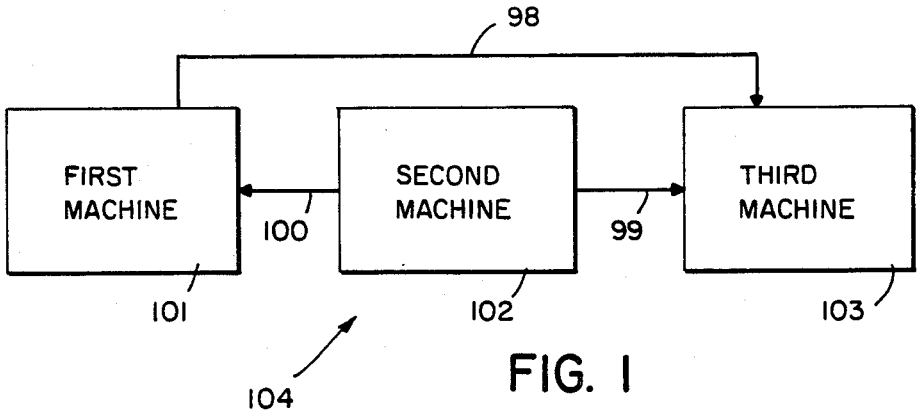
FIG. 1 is a diagrammatic representation of a system that includes plurality of machines that interact to perform operations on a footwear upper assembly, one of the machines being an automatic roughing machine and another of the machines being a bottom cementer.
Figure 2:
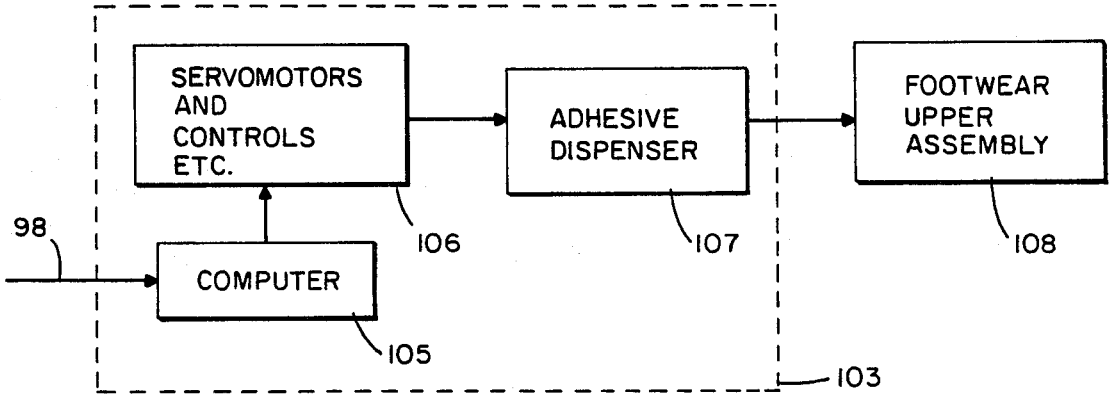
FIG. 2 is a diagrammatic representation of the bottom cementer plus a footwear upper assembly.

Turning now to the drawing, there is shown at 104 in FIG. 1 a system to effect operations on a footwear upper assembly 108 in FIG. 2, that includes a first machine 101, a second machine 102 and a third machine 103. In the context of the present invention, typically the first machine is a six-axis automatic rougher, the second machine, typically, is a transfer arm or the like, and the third machine 103 may be a bottom cementer. As will be clear as this explanation unfolds, the rougher 101, in the course of roughing, gathers digital information defining the path of the cement margin (i.e., the closed-loop path 108A herein) of the footwear upper assembly, which is being roughed by the machine 101. The digital information is transferred to the third machine 103 which, in this explanation, is a bottom cementing machine. Once the cement margin of the upper assembly is roughed, the upper assembly, labeled 108 in FIG. 2, is transferred by the second machine 102 (i.e., a transfer arm; see application for Letters Patent Ser. No. 933,659 filed Nov. 21, 1986 (Williams)) from the first machine 101 to the third machine 103. Meanwhile the digital information has been transferred electrically at 98 to the machine 103 which acts on that information.

In the typical system the cement margin of the upper assembly 108 is roughed; later a ribbon of adhesive is applied onto the cement margin; the upper assembly 108 is heated; and then an outer sole is applied. To apply the adhesive, in the present system, typically digital technology is used. The cement margin must be digitized at some time between roughing and application of the adhesive ribbon that adheres the outer sole to the footwear upper assembly 108. According to the present teaching, the need to digitize subsequent to roughing is eliminated because the digitized data is presented to the third machine—a bottom cementer—when needed, or the digitized data can be transferred at 98 immediately to the third machine 103 and immediately used or stored. Either way, a most costly production step is thereby eliminated.

The machine shown diagrammatically at 103 in FIG. 1 can conceptually be like the automatic rougher, later described in detail. Change from one to the other machine is effected by replacing the roughing wheel of the machine 101 with an adhesive dispenser and making other changes. The third machine 103, as shown in FIG. 2, includes a computer 105 to receive signals along the conductor 98 and servomotors and controls, etc. 106 controlled by the signals, as well as an adhesive dispenser 107 to apply adhesive to the now-roughed cement margin of the footwear upper assembly 108.

It will be appreciated on the basis of the foregoing and what follows that one important aspect of the present invention is the use of digitized information, i.e., the digitized cement margin data acquired during roughing, to guide the cement dispenser 107 of the machine 103 in a subsequent operation on the upper assembly 108. Most of the remainder of this specification is concerned with the first machine 101 which is an automatic rougher or roughing machine, portions of which are shown in FIGS. 3–15, as now explained.

Figure 3:
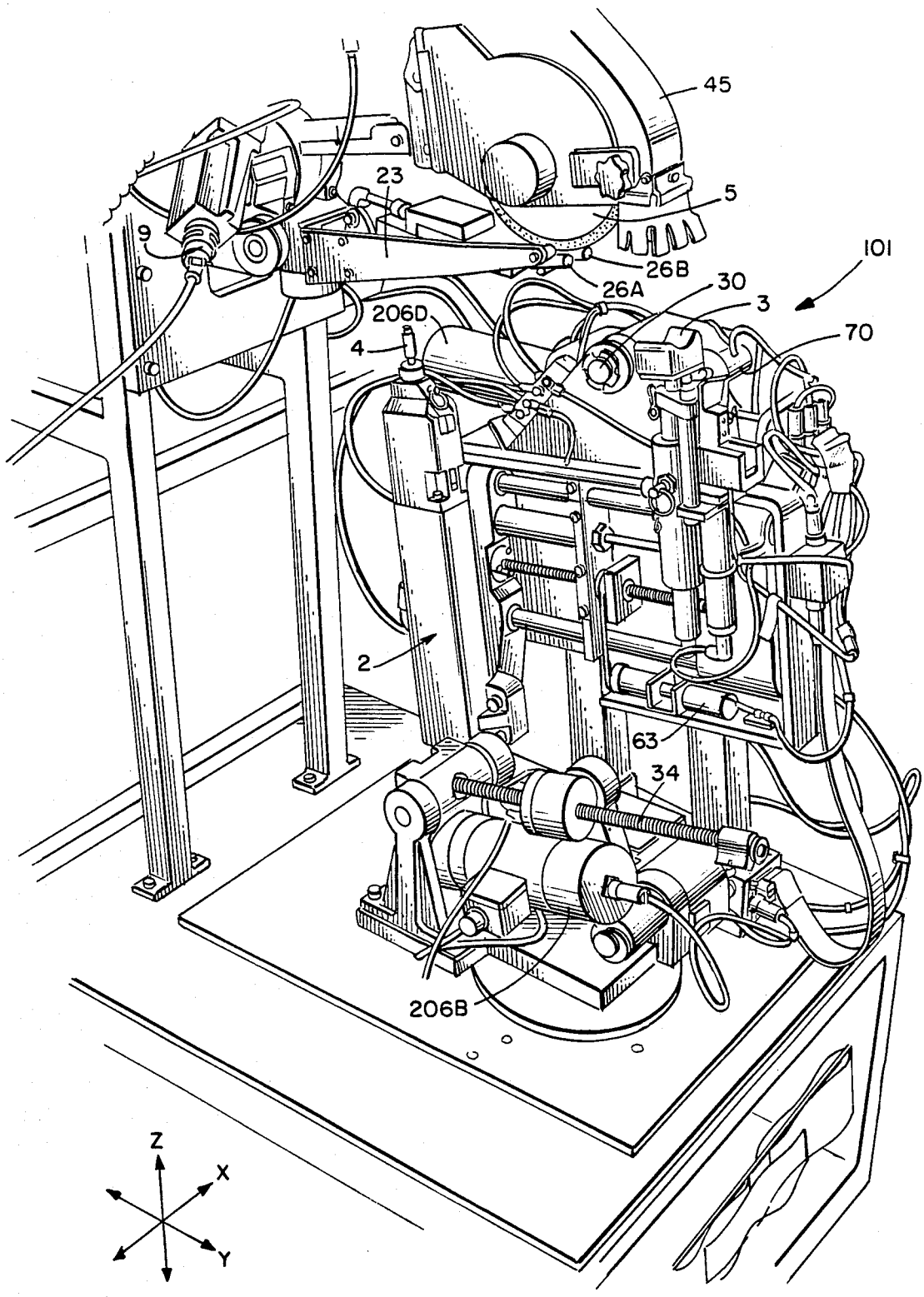
FIG. 3 is an isometric view from the left front of the roughing machine in FIG. 1, which machine is a six-axis machine.

The footwear upper assembly 108 (FIG. 6) has a thimble hole (not shown) which receives a last pin (or heel post) 4; the last pin 4 in FIG. 3 is rotated clockwise to press the toe of the upper onto a toe rest 3, as is known in this art. The function served by the automatic rougher is to achieve roughing of the cement margin labeled 108A (i.e., the closed-loop path of the cementing or bonding surface) in FIG. 6 by a roughing tool (i.e., a wire brush) 5 in the figures. The wire brush 5, which is part of a roughing tool assembly 16 in FIG. 6, rotates away from the edge of the upper, i.e., clockwise in FIG. 6 in the direction of the arrow marked 7. The last pin 4 and related structures serve as an attachment and positioning mechanism 2 that is operable to receive the footwear upper assembly 108 and to secure the footwear upper assembly relative to the roughing tool 5. The attachment and positioning mechanism 2 (which is part of a turret 110) is operable to apply motion of the footwear upper assembly 108 relative to the roughing tool 5 and hence motion of the cement margin 108A relative in the roughing tool 5. (In fact the mechanism 2 is part of the turret 110 which, as later explained, is the larger part of the machine 101 that applies the various movements to the upper assembly 108.) The roughing tool assembly 16, as noted herein, includes one or more devices to maintain roughing force between the roughing tool and the cement margin substantially constant during roughing.

The attachment and positioning mechanism 2 in the figures, as later explained in detail in the context of the turret 110, is capable of applying to the upper assembly 108 rocking movement, translational movements, and rotational movement, the translational movement being orthogonal to the axis of the rotation (i.e., the Z-axis in FIG. 6) of the rotational movement and parallel (i.e., up and down) to the axis of rotation (i.e., the Z-axis). According to the present teaching, the mechanism 2 (which includes the last pin 4, the toe rest 3 and other parts) moves the upper assembly 108 through a combination of rocking movement, translational movements and rotational movement while the roughing tool is roughing the cement margin 108A. The combination of movements serve continuously to permit application of an essentially constant—or controllable—force applied by the roughing tool 5 at the contact area between the roughing tool 5 and the cement margin 108A in the course of roughing, and, hence, uniformity—or controllable non-uniformity—of roughing. The rotational movement (i.e., yaw) about the Z-axis serves to cause the roughing tool 5 continuously to track the cement margin 108A with a determined orientation therebetween (the plane of the wheel 5 is maintained substantially orthogonal to the direction of the cement path) as the cement margin moves past the roughing portions of the roughing tool 5 (see the Becka et al patent). The rotational movement includes angular indexing movement of the upper assembly 108 to maintain the determined orientation substantially constant despite changes in the direction of the path of the cement margin between the toe portion and the heel portion thereof. The rocking movement is about a transverse axis (i.e., the Y-axis in FIG. 6) of the upper assembly 108 located between the toe portion and the heel portion of the upper assembly 108 to achieve, among other things, pivoting of the upper assembly about a pivot parallel to the outer surface of the insole.

Figure 6:
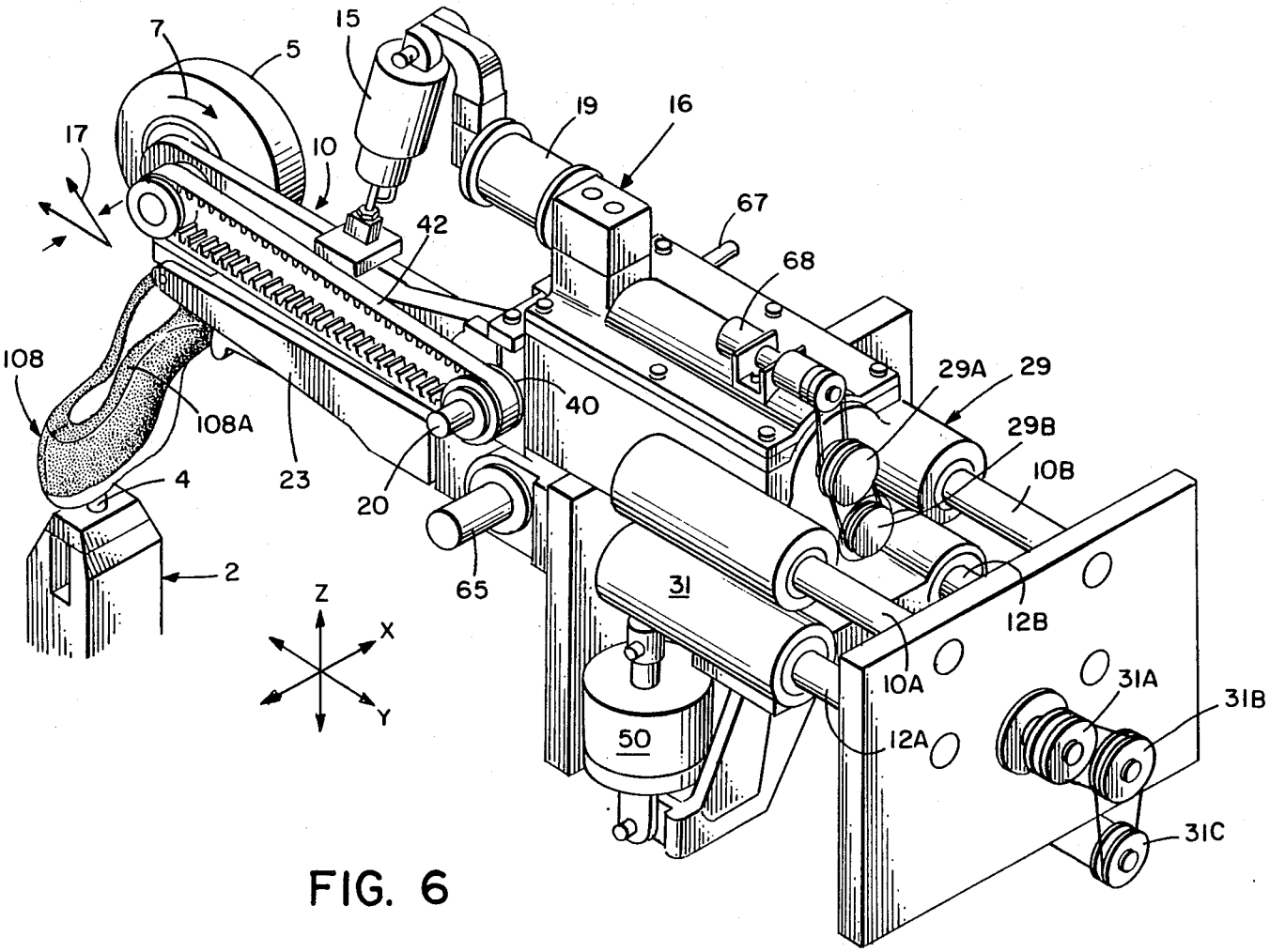
FIG. 6 is an isometric view taken from the right rear looking generally toward the front of the roughing machine and showing a roughing wheel and related parts.
Figure 8:
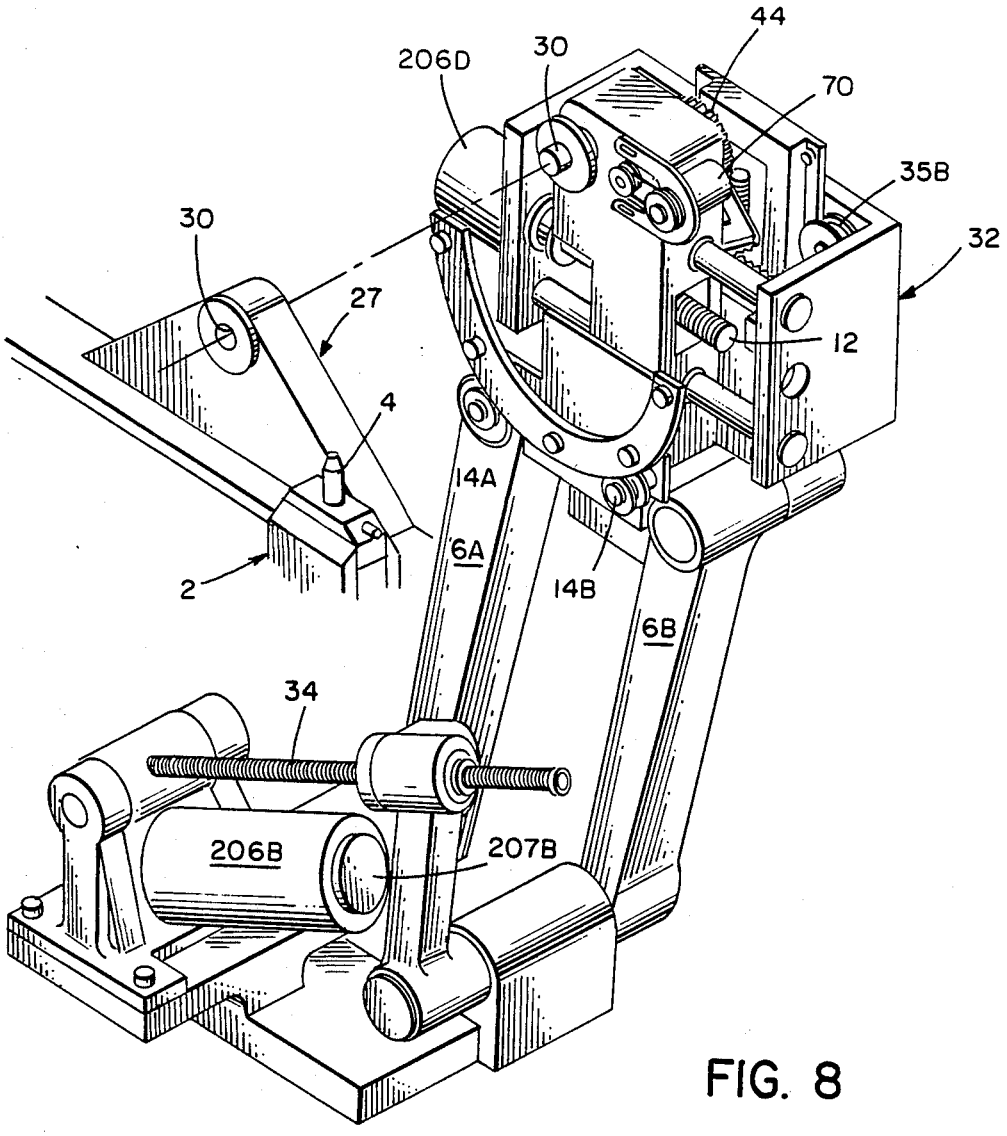
FIG. 8 is an isometric view showing many of the parts in FIG. 7.
Figure 9:
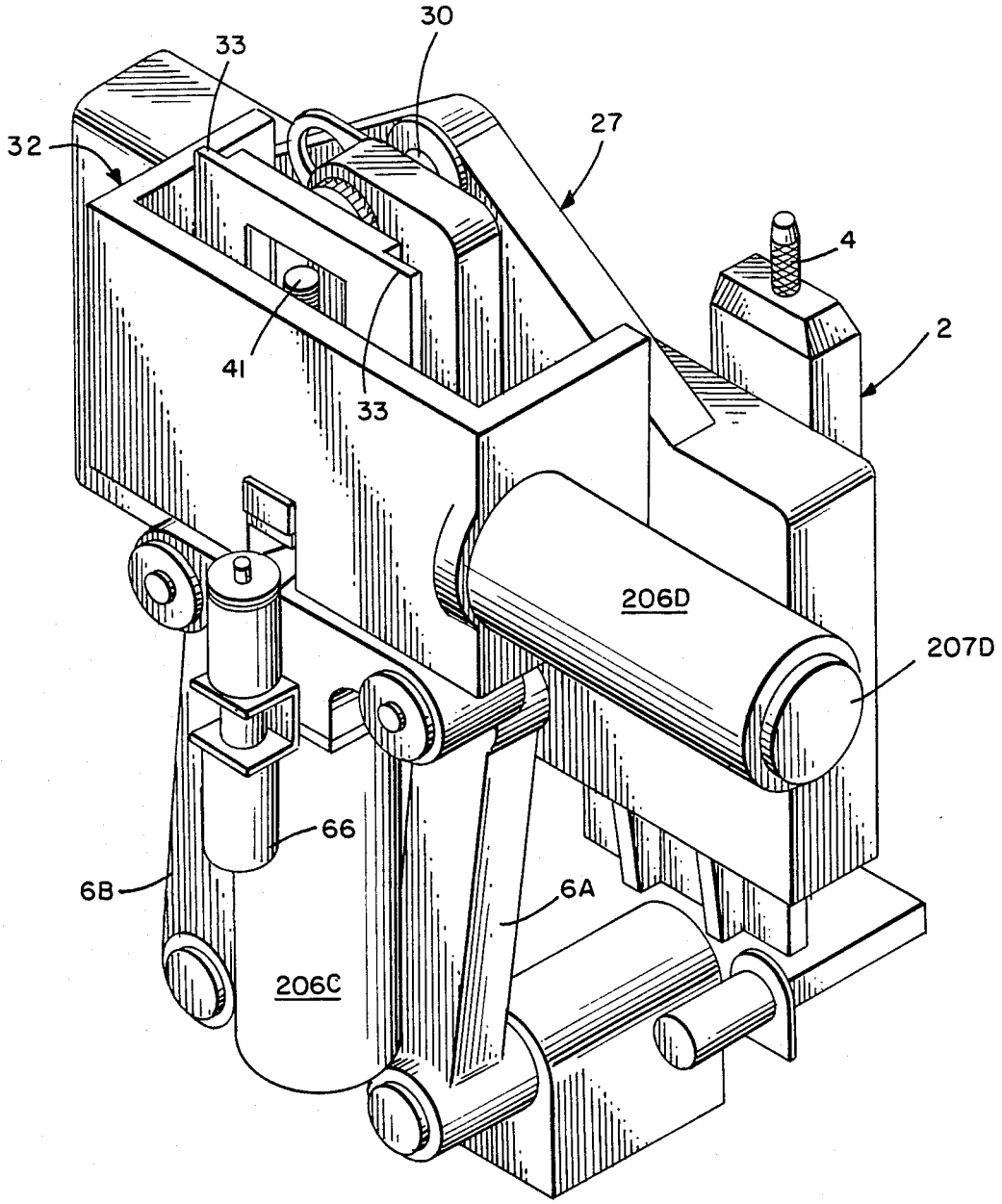
FIG. 9 shows the opposite side of the parts shown in FIG. 8.
Figure 10:
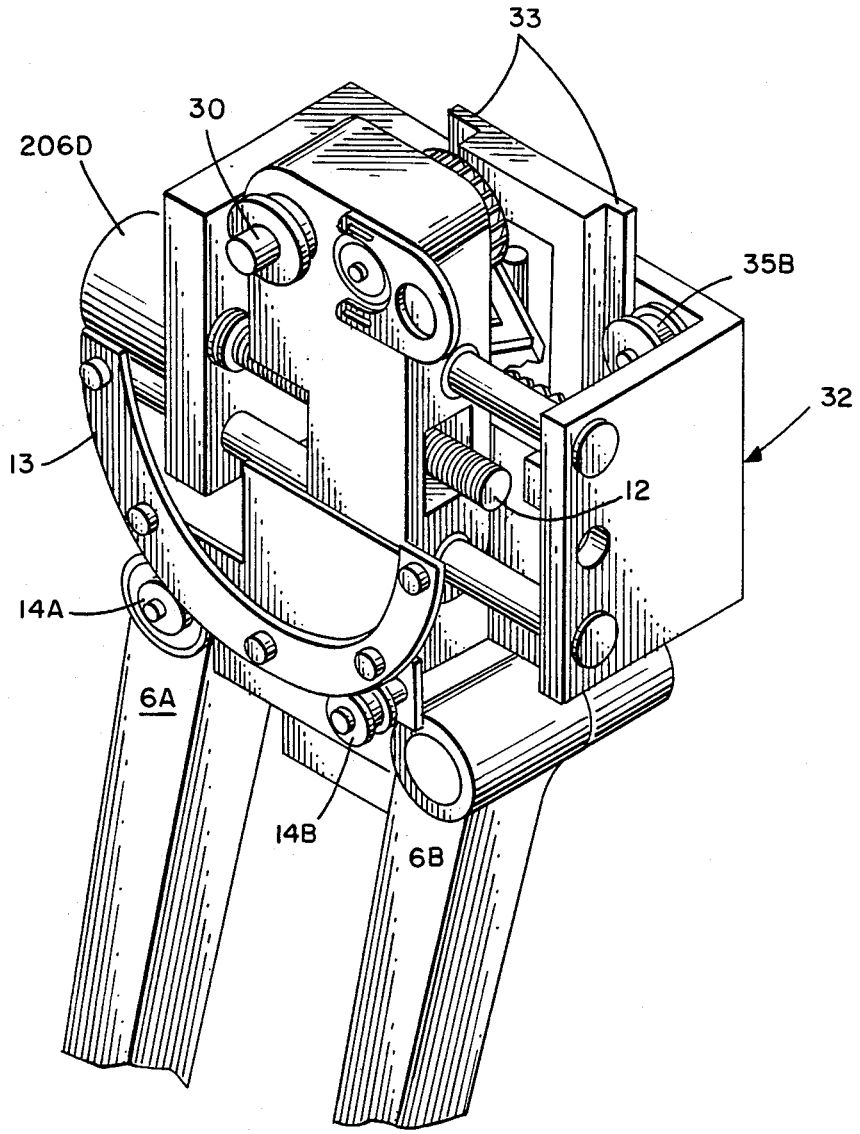
FIG. 10 shows the opposite side of the parts shown in FIG. 9.

It will be noted with respect to the Becka et al patent that an additional translational degree of movement has been added to the machine 101; that is, plus and minus Z movement of the assembly 108 toward and away from the wheel 5 in FIG. 6. (It is noted later that the Z-direction movement also is with respect to a sensing hand or array 23, causing it to move up or down and hence away from an equilibrium position; transducers in the array 23 provide signals which then cause up or down movement of the upper assembly to permit the array 23 to assume its equilibrium—usually about horizontal—position.) The Z-direction movement of the upper assembly 108 reduces the amount of Z-axis movement required of the wheel 5, but is involved in another aspect as well. It is shown later that translational, X-direction movement of the footwear upper assembly 108 in the plus-minus X-direction in FIG. 8 is accomplished in the present machine by pivoting action by arms 6A and 6B, but that introduces plus-minus vertical or Z-direction movement. The master controller labeled 200 in FIG. 11 controls a servomotor and controller herein in a way (as later explained) that raises and lowers the upper assembly 108 relative to the wheel 5 to compensate for the raising and lowering thereof during pivoting by the arms 16A and 16B. (This pivoting is to be distinguished from rocking about the axis 30.) In fact, as noted above and as later explained, vertical movement of the upper assembly 108 is more precise with respect to the sensor hand or array 23 in FIG. 4, which is typically maintained—with respect to its longitudinal axis—about horizontal, that is, if the upper tends to raise or lower (i.e., to pivot) the array 23 from the about horizontal, feedback signals from the resolver 65 cause the servomotor 206B to lower or raise the upper to maintain the about horizontal orientation, but these matters are taken up later. It will be appreciated that significant mass has been removed from the moving parts of machine 101 to provide low mass in the moving elements thereof. This is one such way in which this is done. Hence, during X-direction movement of the assembly 108 in FIG. 6 by virtue of rocking motion of the arms 6A and 6B, the unit 2 is raised and lowered appropriately to present the cement margin, to-be-roughed, appropriately to the roughing wheel 5. A brief comment with regard to FIGS. 12 and 13 now follows.

Figure 12:
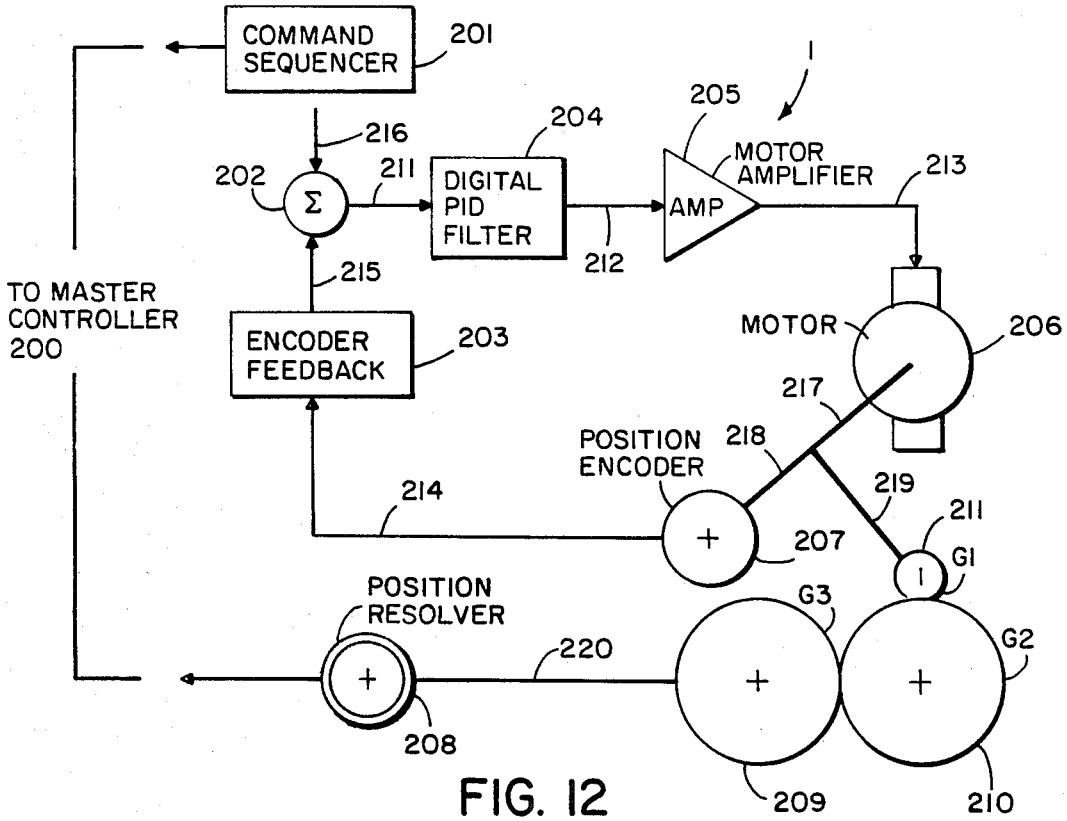
FIG. 12 is a diagrammatic showing of a single axis controller of the six-axis rougher in the earlier figures.

The machine 101, as noted elsewhere herein, is a six-axis machine, each axis having an axis controller like the axis controller labeled 1 in FIG. 12. The six-axes controllers are marked 1A, 1B . . . 1F in FIG. 13 and, for present purposes, respectively represent the turret axis or rotational drive (1A), the transverse axis or X-direction drive (1B), the lift axis or Z-direction drive (1C), the rock axis drive (1D), the margin axis drive (1E) and the sole axis drive (1F). The motor marked 206 in FIG. 12 is typically an electrical servomotor (but can be a hydraulic drive) that is labeled 206 plus a letter designation in other figures: e.g., the label 2O6B designates the transverse axis or X-direction drive motor. That convention is not followed for other parts in the axis controller 1.

The overall operation of the machine 101 is now explained with reference to FIG. 11 and other figures. The master controller 200 orchestrates all the activities of the automatic rougher 101; the controller 200 is further discussed elsewhere herein.

Figure 11:
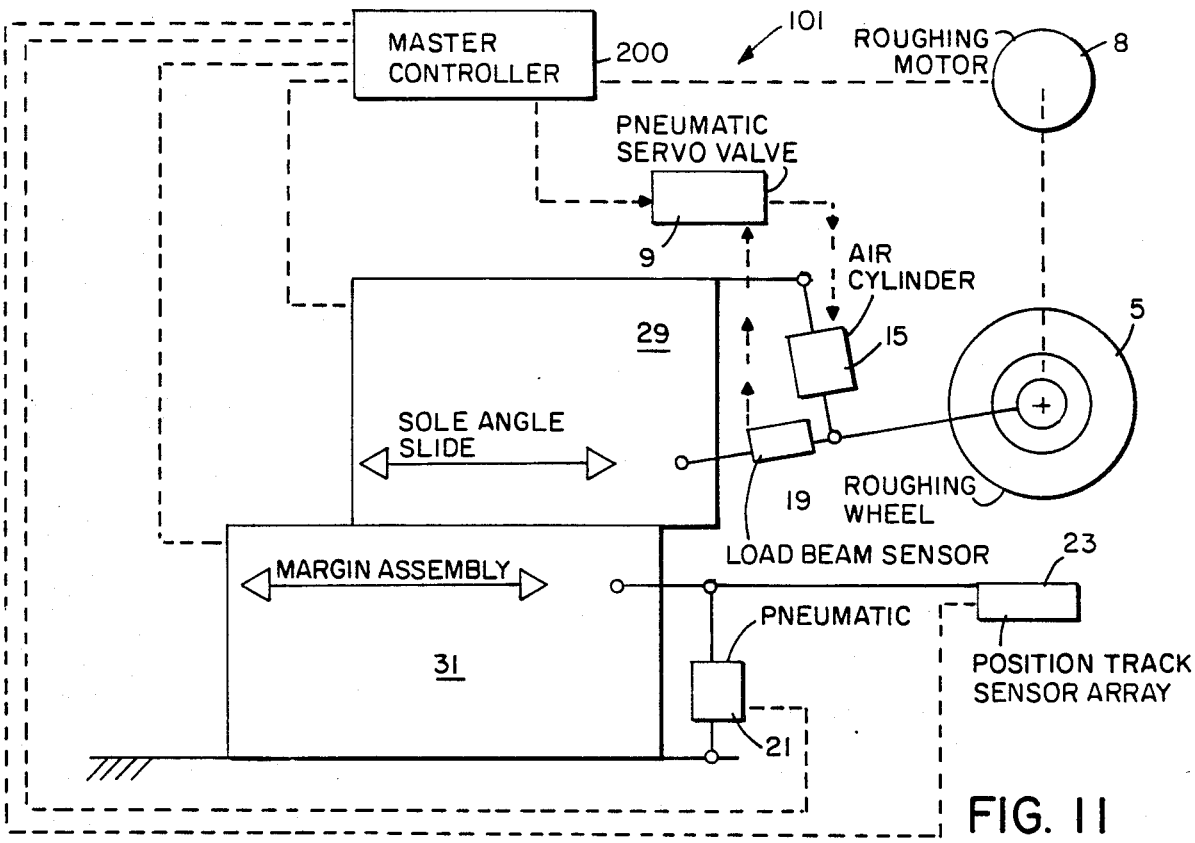
FIG. 11 is a schematic representation of most active portions of the roughing machine in the previous FIGS. 3, 4 and 6.

Most of the drivers in the machine 101, as noted, are servomotors, an important exception being the air cylinder labeled 15 in FIG. 11 which is controlled by a pneumatic servo valve 9. The air cylinder 15 serves to preload the roughing tool 5 toward the cement margin to apply a determinable and closely-controllable force between the roughing tool 5 and the cement margin 108A during roughing. The roughing tool 5 is mounted to move short distances (typically of the order of one-fourth inch) in the Z-direction in FIG. 6 with respect to the cement margin 108A in response to the pre-loading pressure of the air cylinder 15 in FIG. 11 and, more precisely, the brush pressure control designated 15A in FIG. 13.

Figure 15:
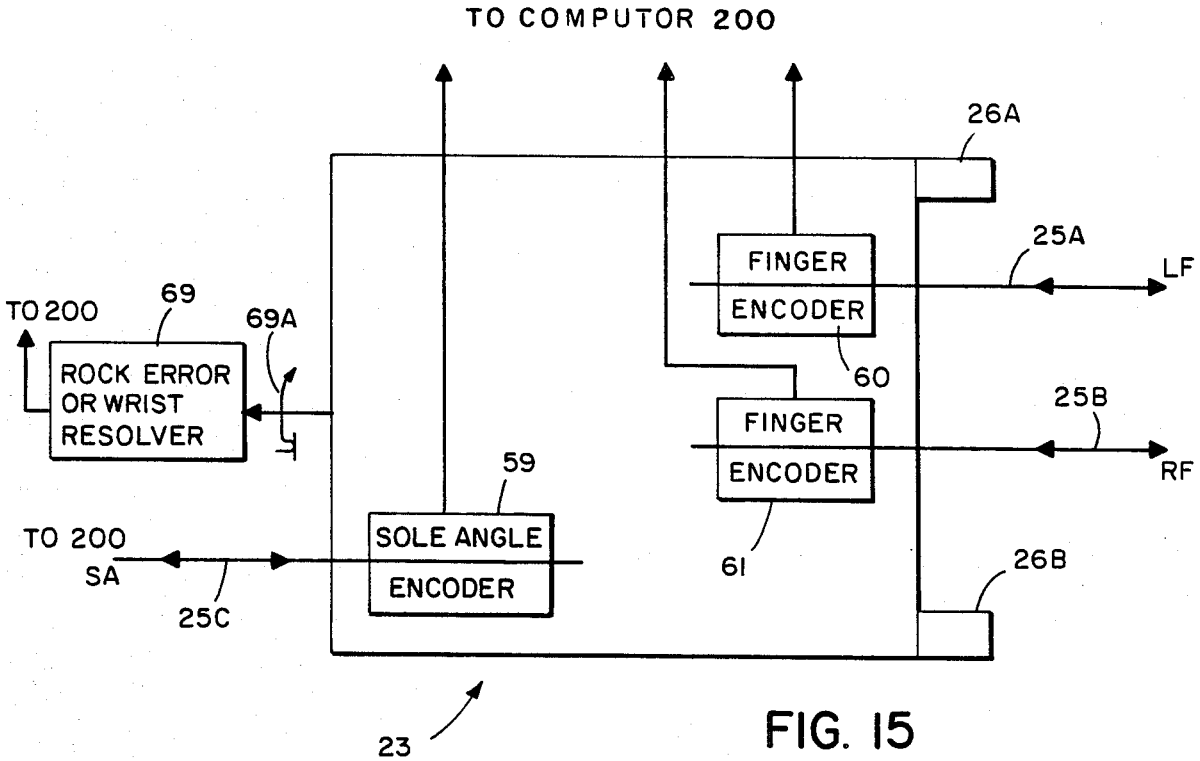
FIG. 15 is a diagrammatic representation of a sensing hand shown in block form in FIG. 13.

The sensing hand 23 in FIG. 15 includes a number of encoders which feed back information—in the form of electrical signals—indirectly to the master controller 200. For convenience the feedback is shown as a direct feedback but, in fact, it passes through other circuit elements as noted herein and as is known to persons in this art. Essentially an encoder is a displacement indicator used to sense position. The finger encoders marked 60 and 61 in FIG. 15, for example, measure and provide feedback information with respect to depression of fingers 25A and 25B. A sole angle encoder 59 measures and provides feedback information with respect to depression of a finger 25C. Other encoders are discussed elsewhere herein.

In FIG. 15 there is a wrist resolver 69 to give rock angle information (i.e., pivoting about the Y-axis in FIG. 6), including path contour. Other resolvers include a transverse resolver 62, a sizing resolver 63, a vertical position resolver 65 (i.e., pivot of the arm 23), a lift resolver 66 (i.e., Z-direction movement of the carriage 32), a brush position resolver 67, a sole angle resolver 68, a rock angle resolver 70, and a turret resolver (not shown) and a margin resolver (not shown). These resolvers are discussed elsewhere.

The automatic rougher 101 includes the sensor hand or array 23 in FIG. 11, which is described in detail herein and which, among other things, establishes position of the cement margin 108A relative to the roughing tool 5. A sole angle slide 29 in FIGS. 6 and 11 between the roughing tool 5 and the array 23 permits positioning in the Y-direction in FIG. 6 of the roughing tool relative to the array 23 and it also positions the rougher 5 relative to the cement margin 108A along the Y-axis.

Figure 4:
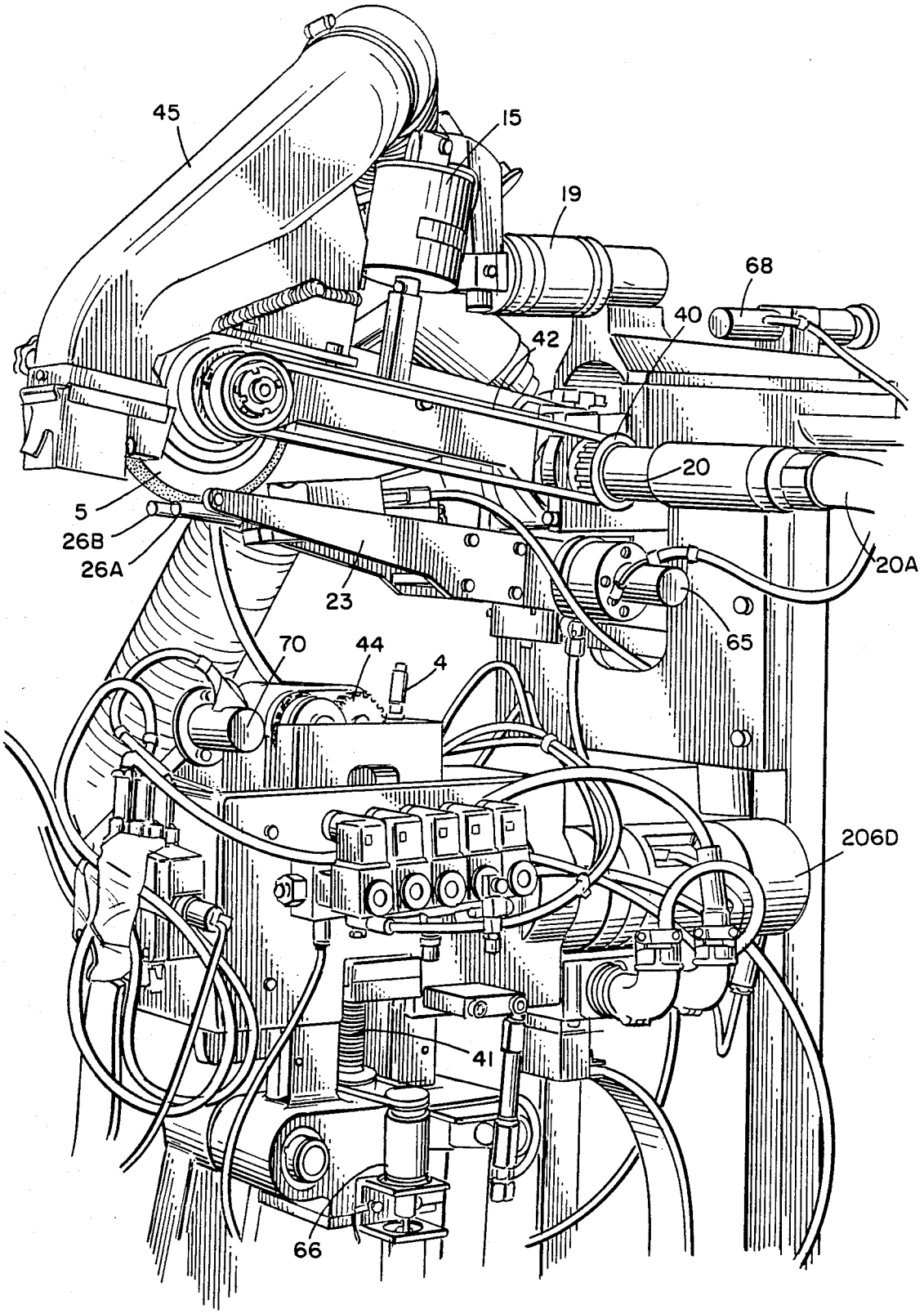
FIG. 4 is an isometric view of the roughing machine of FIG. 3 taken from the right side thereof.
Figure 5:
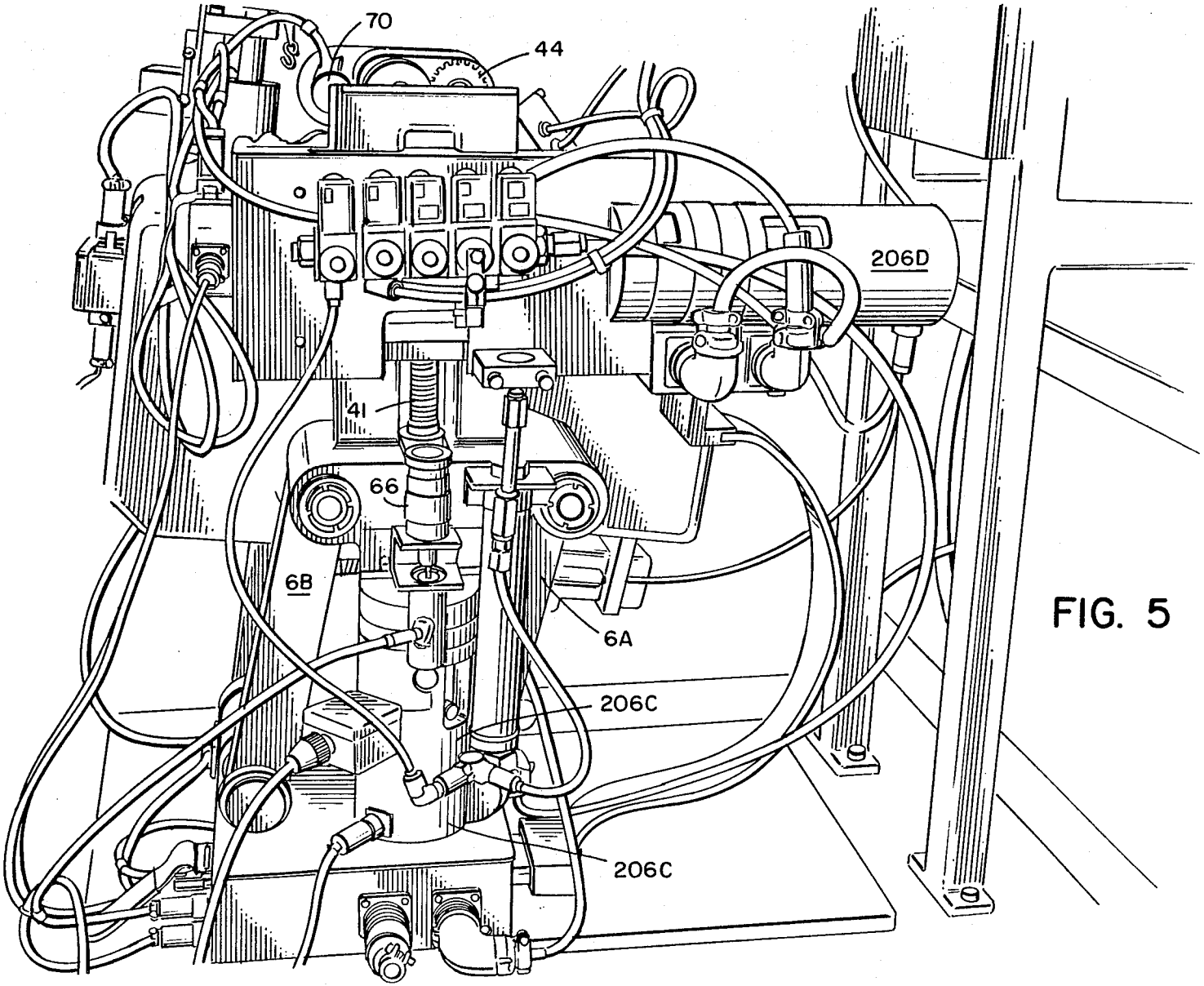
FIG. 5 is a left view of the roughing machine.

The sensor hand or array 23, FIGS. 3 and 4 and 15, etc., has the two fingers 25A and 25B and the two transducers, 60 and 61, respectively (e.g., encoders), in FIG. 15 that act, in combination, to provide a difference signal effective of relative orthogonality between the roughing tool 5 and the cement margin 108A (i.e., orthogonality between the plane of the roughing wheel and the cement-margin path direction) and an average signal that indicates position of the cement margin 108A toward and away from the roughing tool 5. All the signals are interpreted by the master controller 200 and acted appropriately upon. The third finger 25C in FIG. 15 acts in combination with the encoder 59 to measure the crown of the sole of the upper assembly and provides a further feedback signal.

To complete the explanation of FIG. 11, it includes a roughing motor 8 that drives the roughing wheel 5, the sole angle slide or assembly 29 to move the roughing tool toward and away from the upper assembly 108, as well as longitudinally relative to the two fingers 25A and 25B on the basis of signals received from the third transducer 25C to maintain roughing contact between the roughing tool 5 and the cement margin 108A despite change in crown and other parts of the sole of the upper assembly 108. The rougher 101 includes also a margin assembly 31 connected to move the roughing tool 5 and the two fingers 25A and 25B, in combination, relative to the upper assembly 108 (i.e., toward and away from the upper assembly) to maintain proper engagement at the feather line thereof. The sensor hand 23 includes rollers 26A and 26B that ride on the cement margin 108A, a pneumatic preloader 21 in FIG. 11 presses the rollers 26A and 26B onto the cement margin 108A to maintain the roller engagement. The rotary transducer 69 in FIG. 15 is mechanically interconnected to the rollers 26A and 26B by the sensor hand 23 to pivot about a longitudinal pivot axis located between the rollers 26A and 26B to provide rock angle feedback signals to permit the maintenance of the roughing tool interface parallel to the cement margin. The pneumatic preloader 15, which presses the wheel onto the cement margin, is controlled by signals from the pneumatic servo valve 9 to apply a force between about zero and twenty pounds at the brush-margin interface. Control signals to the pneumatic servo valve 9 come from the master controller 200; the servo pressure regulator of the rougher 101 has about a three-millisecond response time and can maintain the needed force between the roughing tool 5 and the cement margin 108A to a tolerance or resolution of about one-half pound and in a range less than a pound to about twenty pounds. The various structures to achieve the needed actions are now taken up; mostly with reference to FIGS. 3–15.

FIG. 3 shows many of the structures discussed above, including the pneumatic servo valve 9, the brush 5, the rollers 26A and 26B and so forth; it (and FIGS. 4–15) also places these and other structures in positional context, as now discussed. As should be apparent, the principal function of the machine 101 is to receive the upper assembly 108; rough the cement margin thereof; and send the duly-roughed upper assembly 108 to another machine to perform an operation thereon. Also, according to the present teaching, during the roughing, information is gathered that guides and determines further operations on the upper assembly 108: e.g., bottom cementing by the machine 103.

There now follows in this and the next few paragraphs a description of the strucures in FIGS. 3–13 that serve to achieve the rocking movement, translational movements, and rotational movement. Rocking of a rock carriage 27 in the direction of the arrow marked 24 in FIG. 7 occurs about a pivot 30. The rock carriage 27 rides on a lift carriage 32, later discussed. Rocking is driven by a rock-angle servomotor 206D. The rock resolver 69 in FIG.13 notes the degree of pivot about the pivot 30. Rock gears are designated 44 in FIG. 4.

Figure 7:
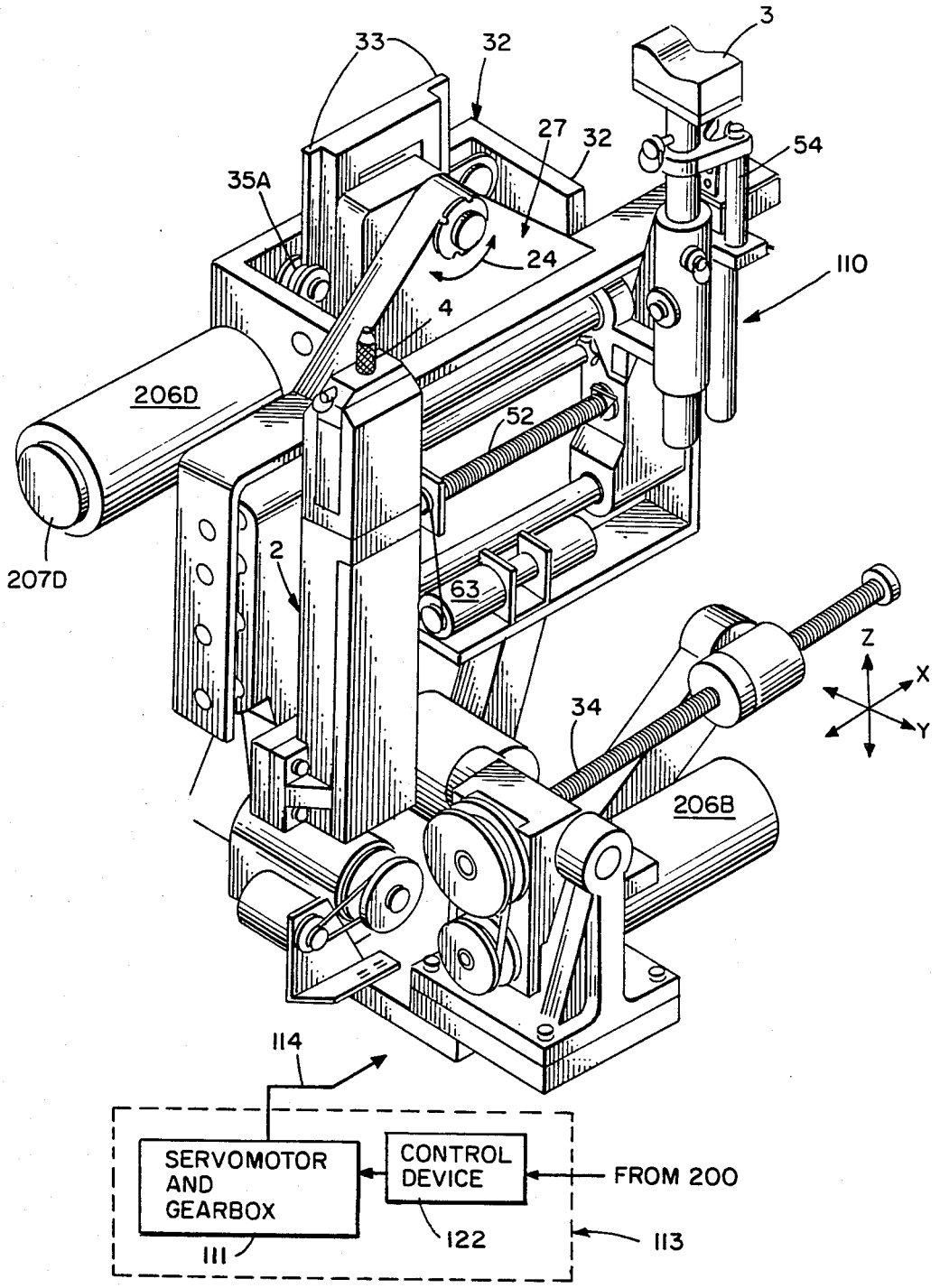
FIG. 7 is a partially diagrammatic representation of the roughing machine but showing also parts below the parts in FIG. 6.

A transverse-drive servomotor 206B drives a transverse lead screw 34 in FIG. 7 through pulleys (as shown) to achieve plus-minus X-direction movement of the upper assembly 108 in FIG. 6. The resolver 62 gives position information. Transverse movement is effected by transverse swing arms 6A and 6B in FIG. 8 which alone would move the upper assembly 108 along an arcuate rocking path, but, in the present system, the rocking-arcuate effect is overcome by translational motion in the Z-direction in FIG. 6, whereby the cement margin 108A is moved toward and away from the roughing tool 5. What happens here is the combination of the "rocking arcuate effect" and the Z-direction translational movement are combined by the controller 200 in such a way that the resultant movement of the upper assembly 108 is plus-minus X in direction or plus-minus X combined with plus-minus Z in direction. Said another way, the combination of movements results in movement of the upper assembly 108 past the wheel 5 in the plus-minus X-direction and in contact with the wheel 5 at the contact region thereof (see the Becka et patent for an explanation of the importance of the contact region); but the upper assembly 108 is simultaneously being raised or lowered (plus or minus Z-direction, respectively). It is this combination of movements that permits very small Z-direction movements of the wheel 5 despite sharp ball-region contours (e.g., with women's shoes) and hence rapid accelerations of the upper assembly 108. The Z-direction movement of the upper assembly 108 is now discussed.

The rock carriage 27 which supports the heel post 4, toe rest 3, and so forth, in FIG. 7 is, in turn, supported by the lift carriage 32. The lift carriage 32 is supported by lift guide rails 33 upon which ride rollers 35A and 35B to permit the Z-direction movement discussed above. Z-direction movement up and down of the lift carriage 32 is driven by a lift servomotor 206C in FIG. 9 through a gear reducer and belt drive to a lead screw 41. The resolver 66 provides Z-direction position information as feedback from the arm 23 to the controller 200. All the structures discussed in this paragraph are part of the turret 110.

In FIG. 6 the wire wheel 5 is driven by the roughing motor 8 in FIG. 11 through a shaft 20 in FIG. 6. The shaft 20 drives a sprocket 40 in FIG. 4 which drives a belt 42 which drives the wheel 5. The label 20A in FIG. 4 designates a flexible shaft between the motor 8 and the shaft 20. Particles from the roughed surface are exhausted by a chute 45. The wire wheel 5 pivots through the angle 17 about the shaft 20 and the pivoting movement is noted by the resolver 67. It will be appreciated that the scheme just described provides a wheel drive with very low inertia with reference to small movement (about one-fourth inch) toward and away from the cement margin. (According to the present teaching the mass of the motor 8 is isolated from the wire wheel 5.) The wire wheel 5 is held in contact with the cement margin 108A by the brush load air cylinder 15 that receives control signals from the pneumatic servo valve 9, as above noted; the load beam sensor 19 provides electrical control signals to the valve 9. Movement of the wheel 5 toward and away from the upper assembly is effected by the sole angle slide 29 in FIGS. 6 and 11, which is driven by a sole angle screw through a pulley 29A which is driven by a pulley 29B, driven by a sole angle motor. The slide rides on shafts 10A and 10B. An air cylinder 50 provides force to maintain the rollers 26A and 26B on the cement margin.

The margin slide 31 in FIG. 6 rides on shafts 12A and 12B driven by a pulley 31A which drives a lead screw; the pulley 31A is a belt driven by a pulley 31B which is attached to a margin drive motor. A pulley 31C is connected to a drive margin resolver (like the resolver 68). The resolvers herein as will be appreciated, give feedback position information to the controller 200 so that the controller is aware at all times of the position of the various parts of the automatic rougher 101.

The label 110 in FIG. 7, as above indicated, designates a turret mechanism (of which the attachment mechanism 2 is a part) that receives the upper assembly 108 in FIG. 6 and is operable to secure the same relative to the automatic rougher. The turret 110 is adapted to apply rocking motion, translational motions and rotational motion to the upper assembly 108 and hence to the cement margin 108A relative to the roughing tool 5, as well as translational motion of the cement margin toward and away from sensor array 23 and hence to the roughing tool to present a uniform area of contact (see the Becka et al patent) at the interface between the roughing tool and the cement margin as well as a controllable rate of removal of the material from the cement margin by the roughing tool.

Rotation and indexing of the mechanism 110 in FIG. 7 is accomplished with apparatus similar to that disclosed in the Becka et al patent and described in detail there. In FIG. 7 the drive mechanism is marked 113 and it consists of a servomotor (i.e., the servomotor 206A) and gearbox 111 and control device 112 which receives control signals from the controller 200. Rotary mechanical forces at 114 are delivered to the turret mechanism 110 much the way it is done in the Becka et al patent.

The turret mechanism 110 in FIG. 7 includes a scheme to establish size of the upper assembly 108. Essentially what is done here is to provide a measure of length of the upper assembly 108 between the heel post 4 and toe rest 3. The elements to accomplish this purpose include a toe switch 54 and a flap switch 56 in FIG. 7 in combination with a sizing screw 52 and the sizing resolver 63. Sizing mechanisms are known in this industry.

A most important aspect of this invention, as above noted, is that, when the cement margin 108A is being roughed, the various resolvers described above send feedback signals to the controller 200 (similar signals are fedback to the controller 200 by the command sequencer 201 discussed later). These feedback signals include information about the closed-loop path of the cement margin. Essentially, the roughing data, which in the automatic rougher 101 is typically with respect to the outline, in plan form, of the roughing path 108A, is saved and is used by the third machine 103 simultaneously or later, as before noted.

Figure 13:
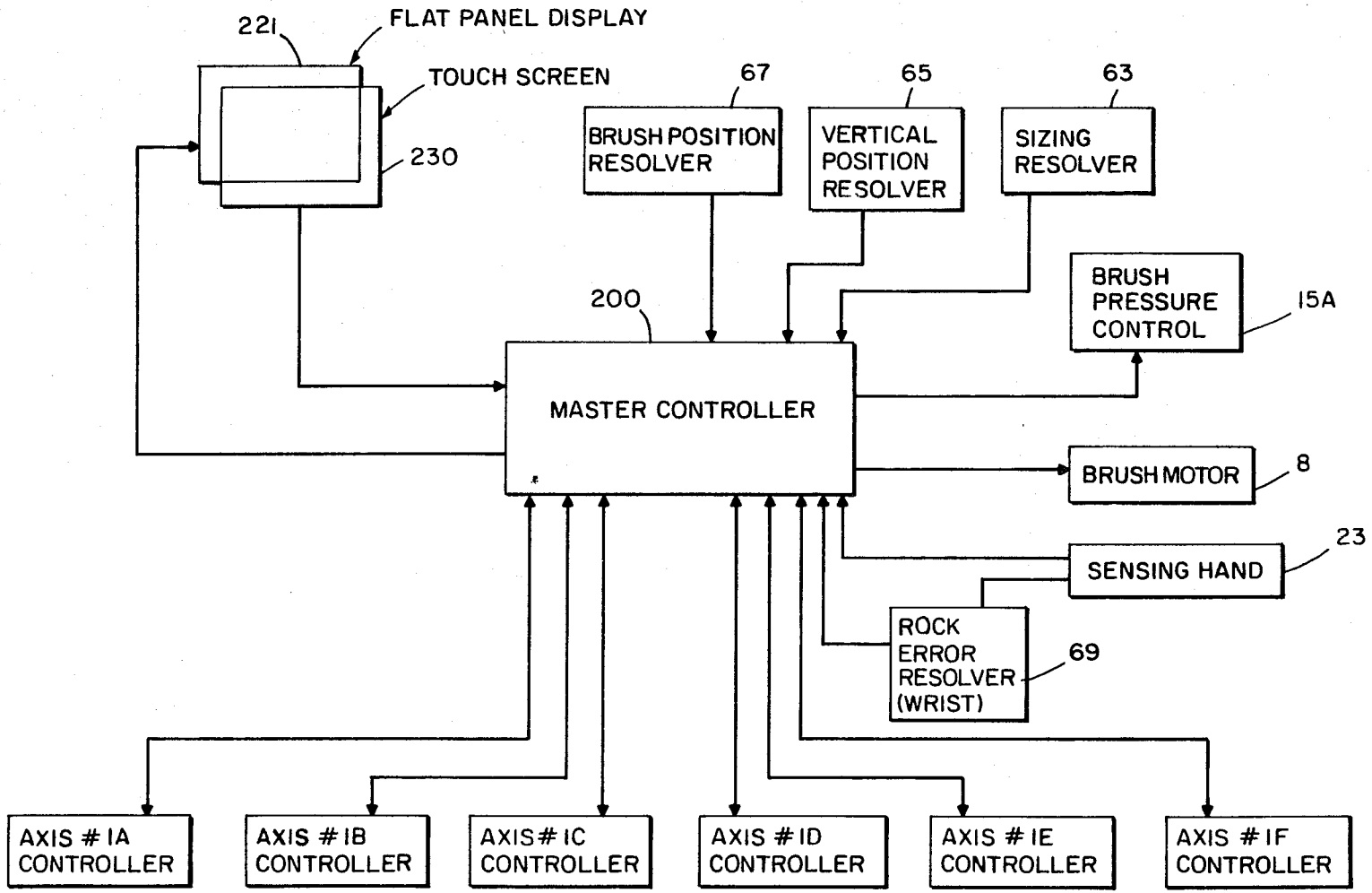
FIG. 13 is a diagrammatic representation showing in block form six of the single-axes controllers in FIG. 12, as well as a flat panel display overlayed by a touch screen.

With the foregoing explanation in mind reference is now made to FIGS. 12 and 13. FIG. 12 shows the elements of a single axis controller 1 of the six-axis machine 101 (or the machine 103). Each of the six-axes contains the elements shown in FIG. 12, the axes controllers being marked axis 1A . . . 1F in FIG. 13. The six axes (1A . . . 1F) can be identified respectively as the turret (i.e., yaw) drive, the transverse or Y-direction drive, the turret lift or Z-direction drive, the rock angle drive, the margin drive and the sole angle drive in FIG. 13.

Each of the six-axes controllers 1A . . . 1F is identical to the typical controller marked 1 in FIG. 12 which includes the command sequencer 201, a summer 202, a digital-integral-differentiator 204, an encoder feedback 203, a motor amplifier resolver 205, a drive motor 206, a gear train 211 (e.g., a gear train drive G1), a final output shaft drive 210 (that is, a final output drive G2). The label 209 (G3) represents a gear reducer; 208 is a resolver; 207 is an encoder. In FIG. 12 the labels 212, 213, 214 and 215 and 216 represent electrical signals and the labels 217, 218, 219 and 220 represent mechanical signals.

Figure 14:
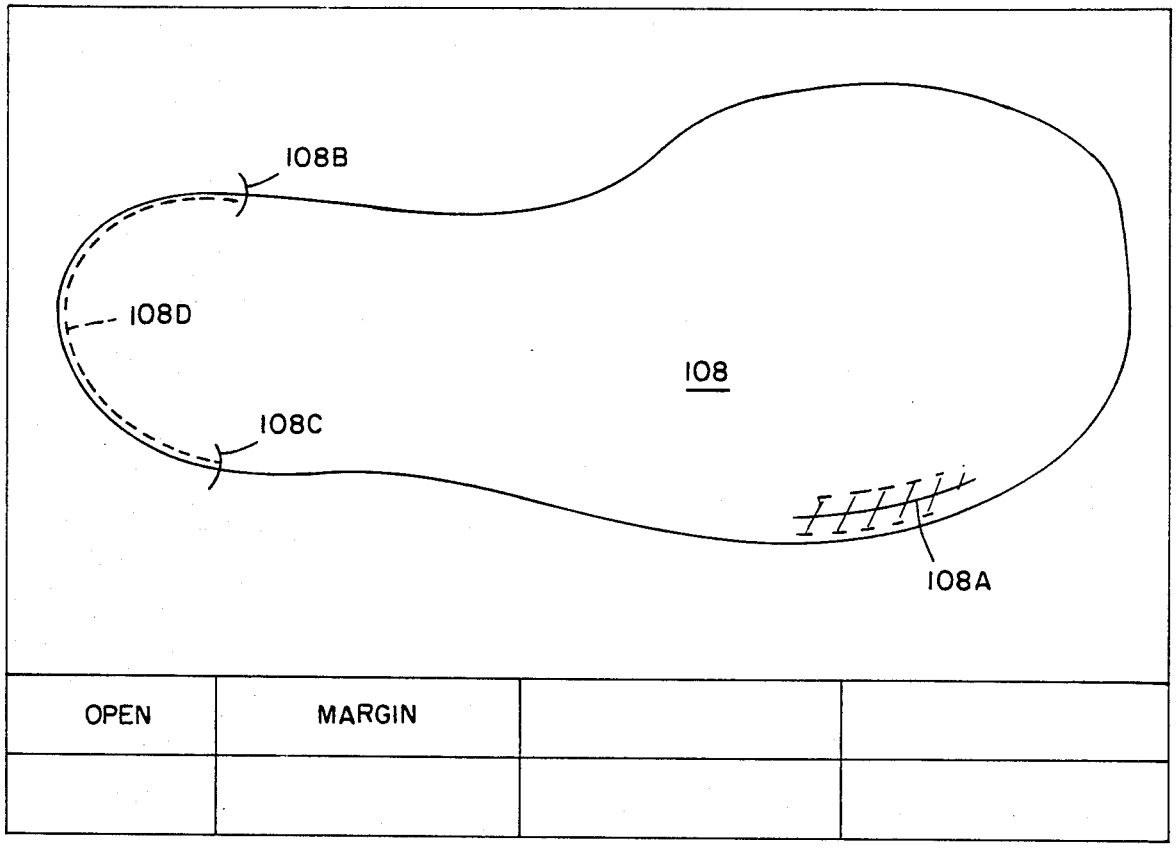
FIG. 14 shows, enlarged, a plan view of the touch screen overlaying the flat panel display of FIG. 13.

In FIG. 13 the brush pressure control 15A can be considered to include the pneumatic valve 9 and the air cylinder 15 in FIG. 11, plus any other local machine elements (e.g., the load beam sensor 19) needed to maintain very precise control of force between the brush 5 and the cement margin at the region contact therebetween. The touch screen labeled 230 in FIGS. 13 and 14—while shown spaced from a flat panel display 221 for display purposes—is disposed immediately adjacent or juxtaposed to the flat panel display 221 so that the two function as a single unit; that is, figures on the display 221 are viewed as though they were on the touch screen 230. Thus the upper assembly 108 in FIG. 14 is shown. The rectangular areas at the bottom of the touch screen: "open," "margin," and so forth are also on the display 221 and serve as instructions to the master controller 200, implemented by an operator pressing with his finger onto the touch screen. This applies also to marks 108B and 108C which, for example, indicate positions on the cement margin 108A at the heel region where the dotted arc 108D means, for example, light roughing.

An aspect of the six-axis machine 101 noted before is further addressed. The motor 206 in FIG. 12, as defined, may be any one of the motors in the axis controllers 1A . . . in FIG. 13, including the lift servomotor marked 206C in FIG. 9. The servomotor 206C serves to raise and lower the carriage 33 in FIG. 9, which raises and lowers (i.e., Z-direction movement) the positioning mechanism 2 that includes the heel post 4 and toe rest 3, and hence the last. In the machine 101 the arm 23 is typically kept about level—but it can be kept at any other predetermined orientation, level being convenient. The up-down movement of the carriage 32 achieves a number of desired results: it accommodates undulations in the upper assembly 108 in response to feed back signals from the sensor hand array 23; and it compensates for Z-direction changes by virtue of angular rocking movements about the axis 30, again in response to signals from the array 23. The up-down movements can also be accomplished in response to input signals to the machine 101 through the touch screen 230, as before noted, upon touch inputs by an operator, it being noted that touch screens per se are known.

The label 30 in FIG. 8 designates a cylindrical opening that receives the shaft, also designated 30, the two acting as the pivot 30. The rocking motor 206D in FIG. 8 drives a rock lead screw 12 that effects rocking of the upper assembly 108. The rock assembly 27 pivots at 30 but derives mechanical stability from an arcuate member 13 in FIG. 8, which is structurally rigidly mechanically connected to the assembly 27 and which rolls in an arcuate path on rollers 14A and 14B in FIG. 8, connected to the lift structure 32. Thus, the last pin 4 in FIG. 8 and other related parts, are subjected to rocking movement and vertical movement. These movements, as are the other movements herein, are effected and monitored in the context of respective axis controllers, as represented at 1 in FIG. 12.

Figure 16C:
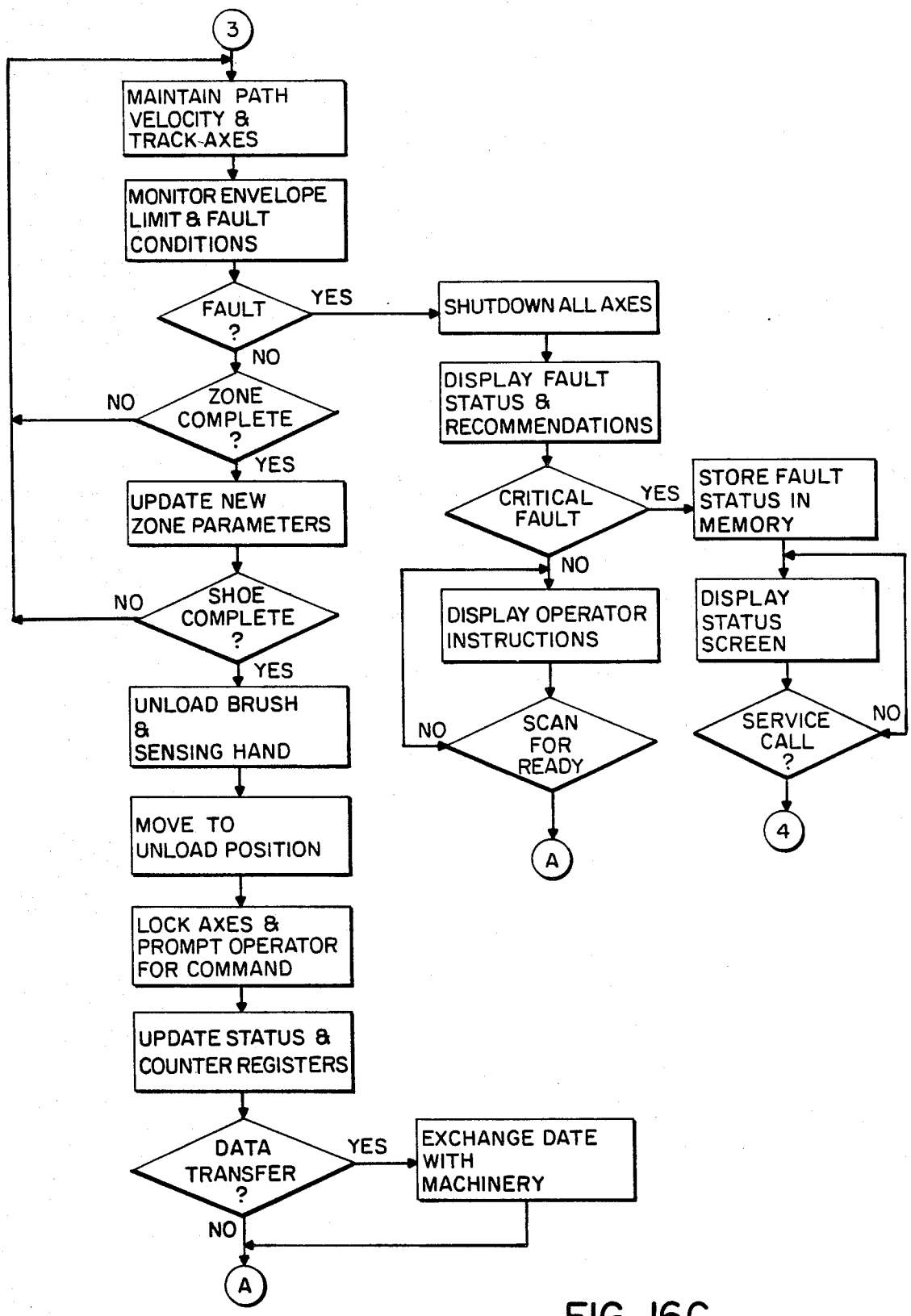
FIGS. 16A. 16B and 16C are flow charts for the circuitry shown in block-diagram form in FIG. 13.
Figure 16A:
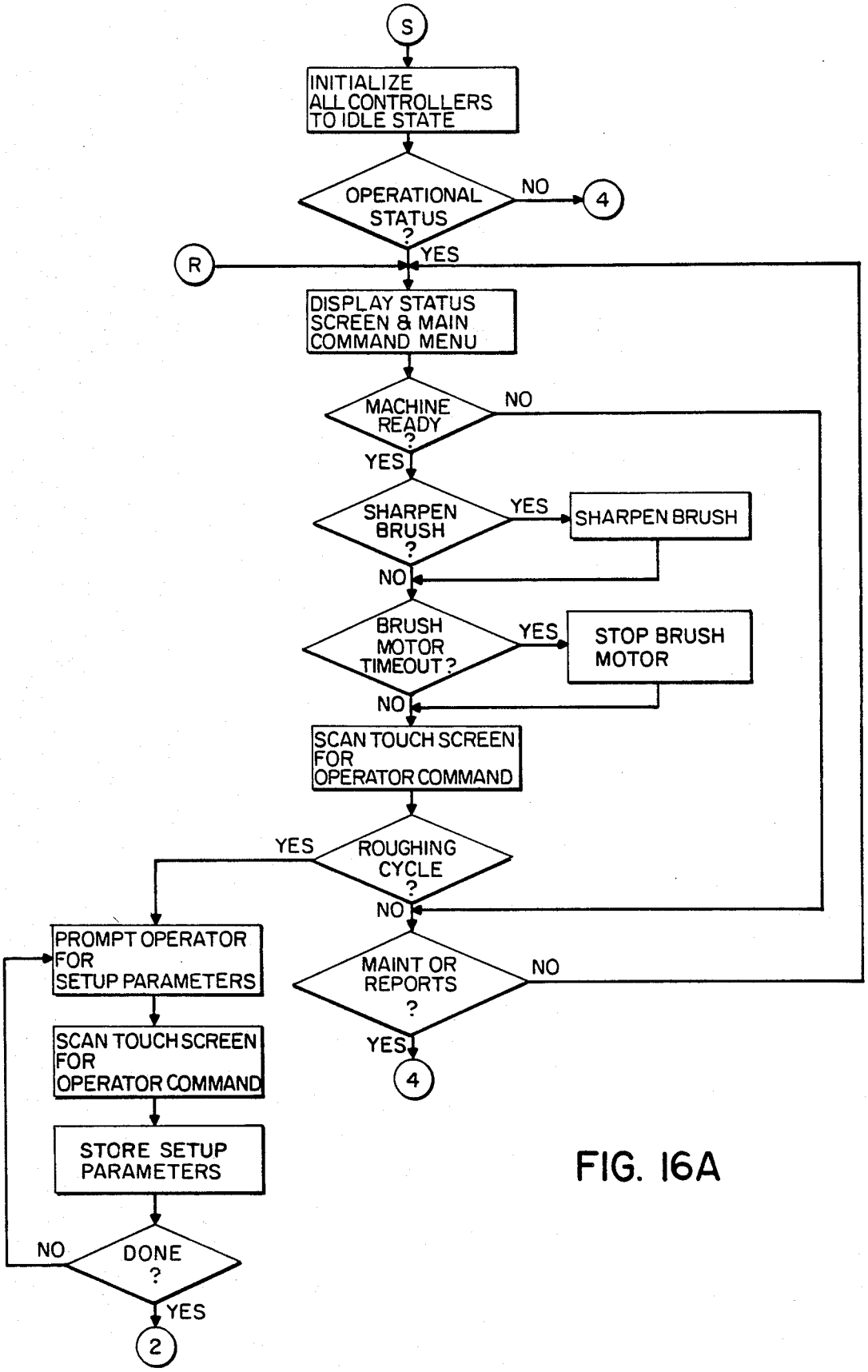
Figure 16B:
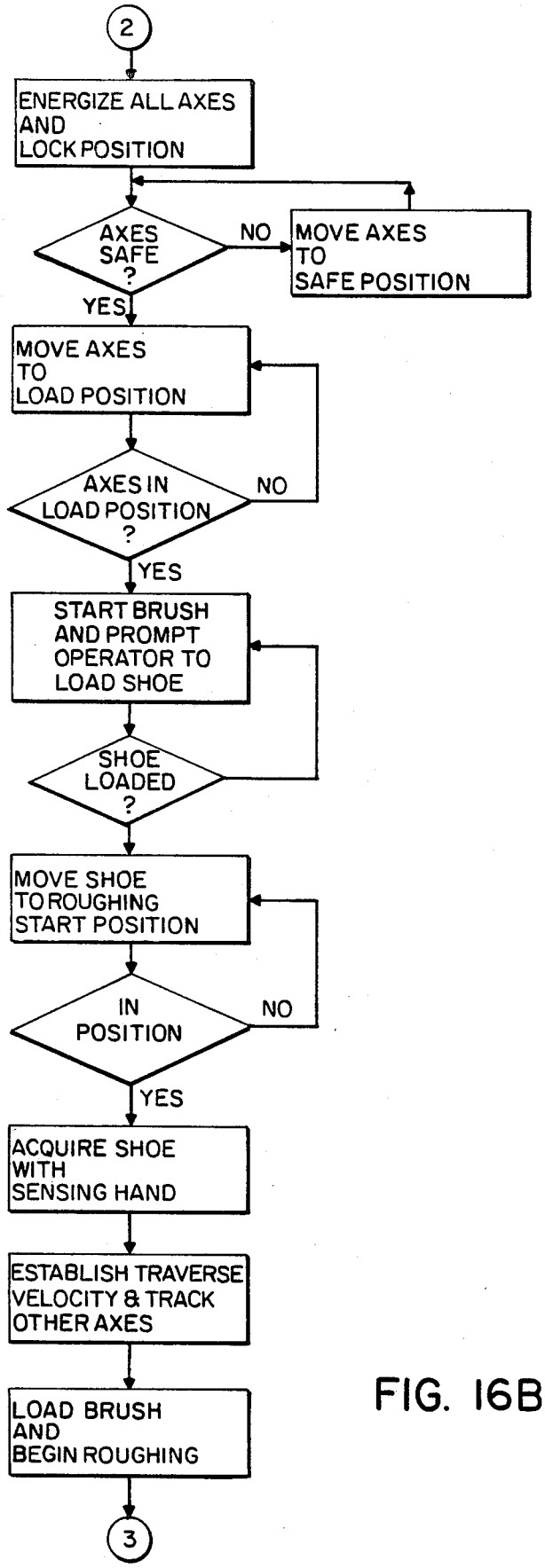

The flow charts shown in FIGS. 16A, 16B and 16C are self explanatory to persons in the art. They tell programmers the many instructions needed by the master controller 200 to accomplish the functions above noted. The master controller 200 in actual apparatus is a computer that drives the dedicated microprocessors that include the elements 201, 202, 203 and 204 to provide real time data for operations of the machine 101.

A few matters are addressed in this paragraph. It should be evident on the basis of the foregoing explanations that great pains have been taken to render responses between the cement margin area of roughing, the wire wheel 5, the array 23, and so forth to provide fine control of the rate of material removal from the cement margin. Thus, the wheel drive motor 8 is isolated by the flexible coupling 20A from the arm 10 that supports the wheel 5 and is not affected by pivoting of the arm 10 about the shaft 20, thereby presenting relatively small moving mass by the brush 5 and related parts. Also the brush pressure control and related parts have very fast response times, as noted. In addition, the digital real time calculations permit the needed real time correction signals to permit the active elements to track the cement margin as it moves relative to the wheel 5 on the basis of feedback signals from the encoders and resolvers. (An encoder, as is known, is an optical position measuring transducer—linear or angular—relative to a known position; a resolver is an electromagnetic device that measures an error signal that indicates position.) It will be appreciated that the controller 200 provides to the axis controllers 1A . . . signals to achieve positioning of the various parts of the machine 101 to achieve a desired rate of removal of material from the cement margin, but, also, the various transducers send back signals that are used to change that positioning, to the extent change is required. These and further aspects of the machine 101 enable close control fo material removal. Typically the Z-direction (up/down) position of the area being roughed is maintained substantially constant throughout a roughing cycle. The labels 207B and 207D are for encoders.

Further modifications of the invention will occur to persons skilled in the art and all such modifications are deemed to be within the scope of the invention as defined by the appended claims.

What is claimed is:

1. A system to effect integrated operations on a footwear upper assembly, that includes a first machine, a second machine and a third machine, which first machine is an automatic rougher, which second machine is a transfer machine and which third machine is adapted to perform further operations on the footwear upper assembly, said footwear upper assembly having a cement margin to-be-roughed, said automatic rougher comprising:

a roughing tool operable to remove material from the cement margin to provide a cementing (i.e., bonding) surface;

attachment and positioning means to receive the footwear assembly and operable to secure and position the footwear upper assembly relative to the roughing tool and provide relative motion therebetween, which motion includes translational movement of the footwear upper assembly toward and away from the roughing tool in the course of roughing to present the footwear upper assembly to the roughing tool;

sensing means that is operable to sense position of the cement margin relative to the roughing tool as the roughing tool effects removal of said material during a cycle of roughing and adapted to provide electrical feedback signals;

computer means connected to receive the electrical feedback signals from the sensing means as roughing proceeds through said cycle, said electrical feedback signals including tracing data representative of the roughing path traversed by the roughing tool; and means to transmit said tracing cycle feedback signals to another machine of said system.

2. A system according to claim 1 in which the automatic-rougher attachment and positioning means includes a rock assembly that pivots the footwear upper assembly about a pivot parallel to the outer surface of the insole at the ball region of the insole.

3. A system according to claim 2 in which the automatic rougher comprises servomotors connected to pivot the upper assembly about said pivot and in which the cement margin is along a closed-loop path.

4. A system according to claim 1 in which the attachment and positioning means of the automatic rougher includes a lift assembly to effect translational motion of the cement margin toward and away from the roughing tool.

5. A system according to claim 4 that includes a roughing tool assembly that includes a transducer that senses force between the roughing tool and the cement margin at the interface therebetween, which force affects the transducer which thereupon generates said feedback signals.

6. A system according to claim 5 in which the roughing tool assembly of the automatic rougher includes a lift device that maintains roughing pressure between the roughing tool and the cement margin substantially constant during roughing.

7. A system according to claim 5 in which the automatic rougher includes means to preload the roughing tool toward the cement margin to apply a determinable and controllable pressure between the roughing tool and the cement margin.

8. A system according to claim 7 in which the roughing tool of the automatic rougher is mounted to move short distances of the order about one-fourth inch with respect to the cement margin in response to the preloading pressures, said preloading pressures being air actuated.

9. A system according to claim 1 in which the automatic rougher includes sensor hand means that notes proximity position of the roughing tool relative to the cement margin, rock angle between the roughing tool on the cement margin and orthogonality between the roughing tool and the cement margin.

10. A system according to claim 9 in which the sensor hand means of the automatic rougher includes a sensor hand that comprises two fingers and two transducers, in combination, to provide a difference signal indicative of relative orthogonality between the roughing tool and the cement margin and an average signal that indicates position of the roughing tool toward and away from the cement margin.

11. A system according to claim 10 in which the automatic rougher further includes a third transducer that measures the crown of the sole of the upper assembly.

12. A system according to claim 11 in which the automatic rougher has a sole angle assembly connected to move the roughing tool toward and away from the upper assembly as well as longitudinally relative to the two fingers on the basis of signals received from the third transducer to maintain desired feather-line contact between the roughing tool and the cement margin despite change in the crown of the footwear upper assembly.

13. A system according to claim 12 in which the transducers include linear encoders.

14. A system according to claim 11 in which the automatic rougher includes a margin assembly connected to move the roughing tool and the two fingers, in combination, relative to the upper assembly to maintain proper engagement at the feather line thereof.

15. A system according to claim 14 in which the sensor hand means includes two rollers that ride on the cement margin, a pneumatic preloader that presses the rollers onto the cement margin to maintain roller engagement, and a rotary transducer mechanically interconnected to the two rollers to pivot about a pivot axis located between the rollers to provide rock angle feedback signals to permit the maintianence of the roughing tool interface parallel to the cement margin at the area of contact therebetween.

16. A system according to claim 15 in which the pneumatic preloader applies force of between about five and fifty pounds and in which the rotary transducer is a resolver.

17. A system according to claim 1 in which the roughing tool of the automatic rougher is a rotatable wire brush and that includes a brush loading assembly to control the roughing tool force onto the cement margin, said brush loading assembly comprising an air cylinder and pneumatic servo valve combination, and a controller to provide control signals to the pneumatic servo valve, which control signals serve as a basis to maintain predetermined air pressure in the air cylinder and hence predetermined and controlled force between the roughing tool and the cement margin.

18. A system according to claim 17 in which the servo pressure regulator of the automatic rougher has about a three-millisecond response time and can maintain said force between the roughing tool and the cement margin to a tolerance or resolution of about one-half pound and in a range less than a pound to about twenty pounds.

19. A method to effect integrated operations on a footwear upper assembly in a system that includes a first machine, a second machine and a third machine, which first machine is an automatic rougher, which second machine is a transfer machine and which third machine is adapted to perform further operations on the footwear upper assembly, said footwear upper assembly comprising a last, a footwear upper disposed on the last and an insole on the last bottom, said footwear upper assembly having a cement margin to-be-roughed, said method comprising:

effecting roughing of the footwear upper assembly by a roughing tool operable to remove material from the cement margin along a closed-loop path to provide a cementing surface therealong;

attaching and positioning the footwear upper assembly by a mechanism that is operable to secure the footwear upper assembly relative to the roughing tool and apply motion of the cement margin relative to the roughing tool, which motion includes translational movement of the footwear upper assembly toward and away from the roughing tool in the course of roughing to present the footwear upper assembly to the roughing tool;

sensing the position of the cement margin relative to the roughing tool as the roughing tool effects removal of said material during a cycle of roughing to provide electrical signals;

receiving the electrical signals as roughing proceeds through said cycle, said electrical signals including tracing data representative of the roughing path traversed by the roughing tool; and transmitting said tracing data to another machine of said system to permit the latter to trace a like path on the basis of the tracing data.

* * * * *